US011528542B1

(12) United States Patent
Zhang

(10) Patent No.: US 11,528,542 B1
(45) Date of Patent: Dec. 13, 2022

(54) MOUNTING DEVICE FOR SPEAKER AND SPEAKER

(71) Applicant: CHINET ELECTRONICS CO., LIMITED, HongKong (CN)

(72) Inventor: Wenping Zhang, Shenzhen (CN)

( * ) Notice: Subject to any disclaimer, the term of this patent is extended or adjusted under 35 U.S.C. 154(b) by 0 days.

(21) Appl. No.: 17/886,482

(22) Filed: Aug. 12, 2022

(51) Int. Cl.
*H04R 1/00* (2006.01)
*H04R 1/02* (2006.01)

(52) U.S. Cl.
CPC ..... *H04R 1/025* (2013.01)

(58) Field of Classification Search
CPC .... H04R 1/025; H04R 1/028; H04R 2499/13; H04R 2499/15; H04R 2420/07; H04R 1/2811; H04R 1/02; H04R 1/345
See application file for complete search history.

(56) References Cited

U.S. PATENT DOCUMENTS

2004/0144906 A1* 7/2004 Hill ..... B60N 2/502 248/421
2013/0230200 A1* 9/2013 Lau ..... H04R 1/02 381/332
2016/0241939 A1 8/2016 Kieltyka et al.
2019/0045285 A1 2/2019 Fukuhara et al.
2021/0329371 A1 10/2021 Li et al.

* cited by examiner

*Primary Examiner* — Amir H Etesam

(57) ABSTRACT

The present disclosure provides a mounting device for a speaker and a speaker. The mounting device includes a central shaft, an abutting piece, an elastic piece and a fixing piece. The abutting piece includes a body part and an abutting part, the body part is nested with and to the central shaft. The elastic piece is provided between the central shaft and the body part. The fixing piece penetrates through the speaker so as to be connected with the central shaft. The fixing piece is configured for driving the abutting piece to rotate, such that the abutting part is capable to be rotated to a chute of the boss so as to be abutted with the top wall, such that the mounting steps of the speaker body can be simpler, the mounting is more convenient, with a higher safety and a lower labor intensity.

10 Claims, 12 Drawing Sheets

MOUNTING DEVICE FOR SPEAKER AND SPEAKER

TECHNICAL FIELD

The present disclosure relates to the technical field of speakers, and in particular, to a mounting device for a speaker and a speaker.

BACKGROUND

Speakers are transducers that convert electrical signals into acoustic signals, and have been widely used in various fields. The performance of the speaker and the mounting location have a great impact on the sound. In many application scenarios, such as shopping malls with large space, Karaoke TV, etc., in order to achieve better sound effects, it is usually necessary to mount speakers on top walls such as ceilings.

At present, the mounting of speakers on the top wall is generally carried out by the mounter holding a power tool such as an electric drill to drill holes and tighten the screws. The mounting steps are complicated, the labor intensity is high, and the power tool has the risk of falling. The risk of puncturing the speaker during installation is high.

SUMMARY

The present disclosure provides a mounting device for a speaker and a speaker to solve the technical problem of inconvenient mounting of the speaker on the top wall in the prior art.

In order to solve the above-mentioned technical problems, a technical solution adopted by the present disclosure is to provide a mounting device for a speaker for mounting a speaker body on a top wall, wherein the mounting device comprises:

a central shaft;

an abutting piece comprising a body part and an abutting part protruding from the body part, the body part is nested with and fixedly provided relative to the central shaft;

an elastic piece provided between the central shaft and the body part, and connected or abutted with a top, end of the central shaft and the abutting piece respectively;

a fixing piece penetrating through a base of the speaker so as to be connected with the central shaft;

wherein, the fixing piece is configured for driving the abutting piece to rotate through the central shaft, such that the abutting part mounted on a top surface of a boss of the base is capable to be rotated to a chute of the boss so as to be abutted with the top wall.

According to one embodiment of the invention, the mounting device further comprising a locking piece provided between the central shaft and the abutting piece, and configured for locking with the abutting piece.

According to one embodiment of the invention, wherein the locking piece is provided with a first limit part on an inner side wall, the central shaft is provided with a second limit part on an outer side wall, and the first limit part and the second limit part are mated for limiting a position; the locking piece is provided with an outer thread at one side of an outer side wall, and the body part of the abutting piece is provided with an inner thread at one side of an inner side wall, the outer thread and the inner thread are mated and locked.

According to one embodiment of the invention, wherein when the abutting part is mounted on the top surface of the boss, the inner thread and the outer thread are spaced apart, and an area of the inner thread is larger than that of the outer thread.

According to one embodiment of the invention, wherein the inner side wall of the body part is further formed with a protrusion provided on one side of the inner thread.

According to one embodiment of the invention, the mounting device further comprising a gasket provided on the fixing piece and located between the base of the speaker and the central shaft According to one embodiment of the invention, wherein a middle part of the central shaft is provided in an elliptical shape, the body part of the abutting piece is formed with a through hole with an elliptical shape, and the middle part of the central shaft is nested with the through hole, such that the abutting piece is capable to rotate with the central shaft.

According to one embodiment of the invention, wherein the abutting part is provided in an L-shape or a Z-shape.

According to one embodiment of the invention, wherein one end of the elastic piece is fixedly connected to the central shaft, and the other end is affixed to the body part of the abutting piece.

In order to solve the above-mentioned technical problems, a technical solution adopted by the present disclosure is to provide a speaker comprising the speaker body and the mounting device above mentioned, and the mounting device is configured for mounting the speaker body on the top wall.

The present disclosure provides a mounting device for a speaker and a speaker. The mounting device includes a central shaft, an abutting piece, an elastic piece and a fixing piece. The abutting piece includes a body part and an abutting part protruding from the body part, the body part is nested with and affixed to the central shaft. The elastic piece is provided between the central shaft and the body part, and is connected or abutted with a top end of the central shaft and the abutting piece respectively. The fixing piece penetrates through a top of a base of the speaker so as to be connected with the central shaft. Wherein, the fixing piece is configured for driving the abutting piece to rotate through the central shaft, such that the abutting part mounted on a top surface of a boss of the base is capable to be rotated to a chute of the boss so as to be abutted with the top wall, such that the mounting steps of the speaker body can be simpler, and only need to rotate the fixing piece with a simple tool such as a wrench, making the mounting more convenient. Due to no electric tools required, the safety is higher and the labor intensity is lower.

BRIEF DESCRIPTION OF DRAWINGS

In order to illustrate the technical solutions in the embodiments of the present disclosure more clearly, the following briefly introduces the accompanying drawings used in the description of the embodiments. Obviously, the accompanying drawings in the following description are only some embodiments of the present disclosure. For those of ordinary skill in the art, under the premise of no inventive work, other drawings can also be obtained from these drawings, wherein:

FIG. 1-10-mounting device, FIG. 1-100-central shaft, FIG. 3-110-first fixing part, FIG. 2-120-middle part, FIG. 6-130-second limit part, FIG. 1-200-abutting piece, FIG. 2-210-body part, FIG. 8-211-limiting groove, FIG. 8-212-elliptical through hole, FIG. 9-213-inner thread, FIG. 11-214-protrusion, FIG. 2-220-abutting part, FIG. 8-221-first bending portion, FIG. 8-222-second bending portion, FIG. 8-223-third bending portion, FIG. 9-224-protrusions, FIG. 1-300-elastic piece, FIG. 1-400-fixing piece, FIG. 7-410-fixed connecting part, FIG. 7-411-second fixing part, FIG. 7-420-fixed body part, FIG. 7-421-mounting hole, FIG. 2-500-locking piece, FIG. 10-510-first limit part, FIG. 10-520-outer thread, FIG. 12-600-gasket, FIG. 4-20-base of the speaker, FIG. 4-201-boss, FIG. 4-202-chute, FIG. 4-30-top wall.

DESCRIPTION OF EMBODIMENTS

Figure 1:
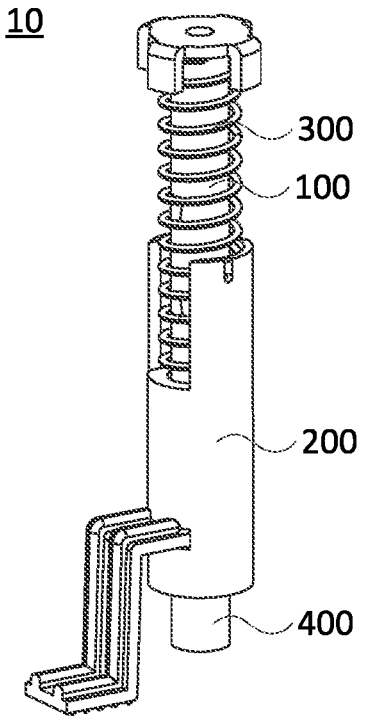
FIG. 1 is a schematic three-dimensional structural diagram illustrating an embodiment of a mounting device for a speaker according to the present disclosure.
Figure 2:
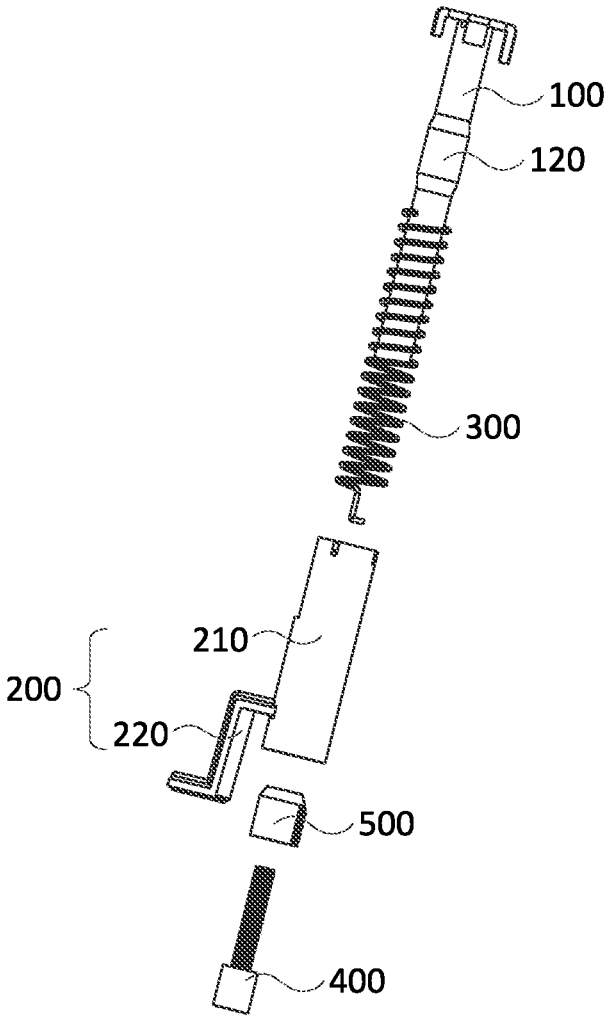
FIG. 2 is a schematic exploded structural diagram illustrating an embodiment of the mounting device for the speaker according to the present disclosure.
Figure 3:
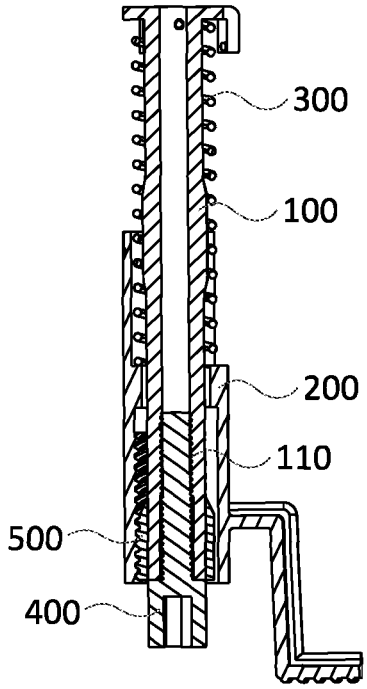
FIG. 3 is a schematic cross-sectional structural diagram illustrating an embodiment of the mounting device for the speaker according to the present disclosure.

The technical solutions in the embodiments of the present disclosure will be clearly and completely described below with reference to the accompanying drawings in the embodiments of the present disclosure. Obviously, the described embodiments are only a part of the embodiments of the present disclosure, but not all of the embodiments. Based on the embodiments of the present disclosure, all other embodiments obtained by those of ordinary skill in the art without inventive efforts shall fall within the protection scope of the present disclosure.

Referring to FIGS. 1 to 5, the mounting device 10 for a speaker of the present disclosure is used to mount the speaker body (not shown in the figures) on the top wall 30, The mounting device 10 may include a central shaft 100, an abutting piece 200, an elastic piece 300 and a fixing piece 400. The abutting piece 200 may include a body part 210 and an abutting part 220 protruding from the body part 210; the body part 210 may be nested with the central shaft 100 and relatively fixedly provided. The elastic piece 300 may be provided between the central shaft 100 and the body part 210, and may be connected or abutted with the top end of the central shaft 100 and the abutting piece 200 respectively. The fixing piece 400 may penetrate through the base 20 of the speaker so as to be connected with the central shaft 100. Wherein the fixing piece 400 may be used for driving abutting piece 200 to be rotated through the central shaft 100, such that the abutting part 220 mounted on the top surface of the boss 201 of the base 20 can be rotated to the chute 202 of the boss 201 so as to be abutted with the top wall 30 (the top surface of the top wall 30 is flush with the top surface of the base 20). Compared with the locking screw mounting, the mounting steps of the speaker body can be made simpler, and the fixing piece only needs to be rotated by a simple tool such as a wrench, and the mounting is more convenient, with a higher safety and a lower labor intensity, since no electric tool is required. Lowers the risk of puncturing the speaker during installation. The embodiment affects service ability by making it easier to install or uninstall so that it reduces the need for installation hardware.

In the present embodiment, the thickness D1 of the top wall 30 may be less than or equal to the mounting thickness D2 of the base 20, such that the abutting part 220 can be mounted and abutted on the top wall 30.

Figure 6:
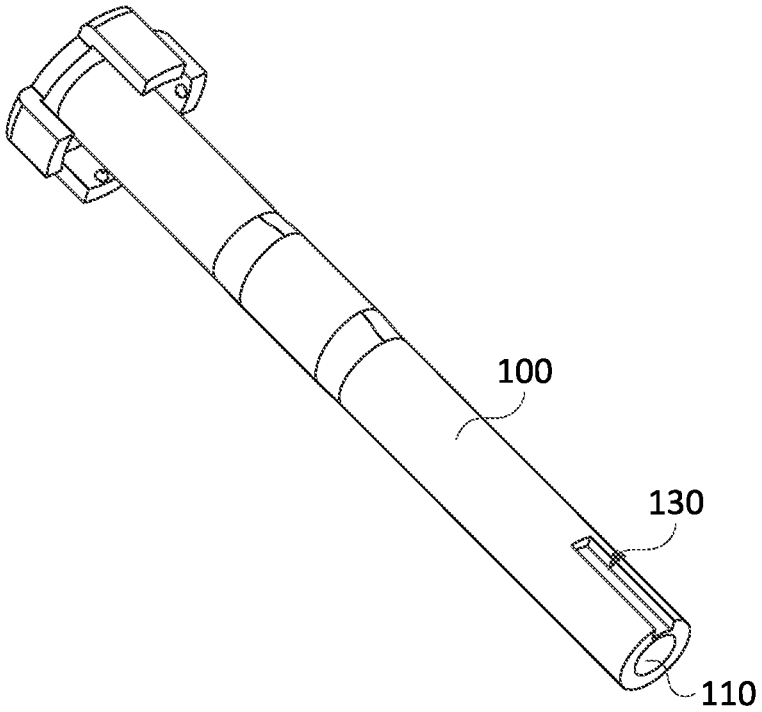
FIG. 6 is a schematic three-dimensional structural diagram illustrating a central shaft in an embodiment of the mounting device for the speaker according to the present disclosure.
Figure 7:
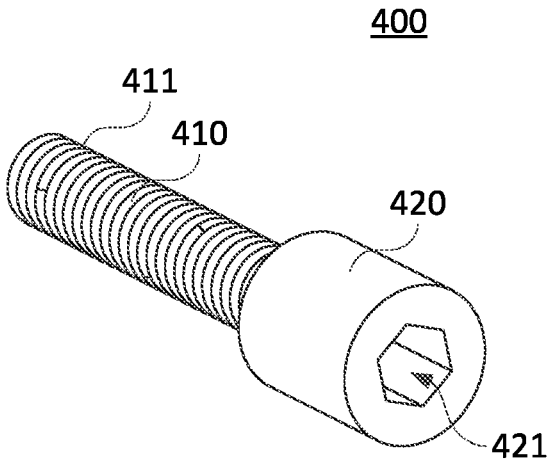
FIG. 7 is a schematic three-dimensional structural diagram illustrating a fixing piece in an embodiment of the mounting device for the speaker according to the present disclosure.

Referring to FIGS. 6 and 7, in the present embodiment, the bottom of the central shaft 100 may be provided with a first fixing part 110, the top of the fixing piece 400 may be provided with a second fixing part 411, and the first fixing part 110 and the second fixing part 411 are mated to realize fixed connection.

In the present embodiment, the first fixing part 110 may be an inner thread formed on the inner side wall of the central shaft 100, the second fixing part 411 may be an outer thread formed on the outer side wall of the fixing piece 400, and the inner thread and the outer thread are mated to realize fixed connection.

In other embodiments, the first fixing part 110 and the second fixing part 411 may also be snaps, interference fit structures, etc., which are not limited herein.

In the present embodiment, one end of the elastic piece 300 may be affixed to the central shaft 100, and the other end may be affixed to the body part 210 of the abutting piece 200, such that the elastic piece 300 can drive the abutting piece 200 back to the initial position, and can also prevent the central shaft 100 and the elastic piece 300 from being separated from the abutting piece 200 under the elastic force of the elastic piece 300, when the speaker body is disassembled.

In other embodiments, the central shaft 100 may not be affixed with the abutting piece 200 through the elastic piece 300, but may be limited relative to the abutting piece 200 by a limiting structure, which is not limited herein.

Figure 8:
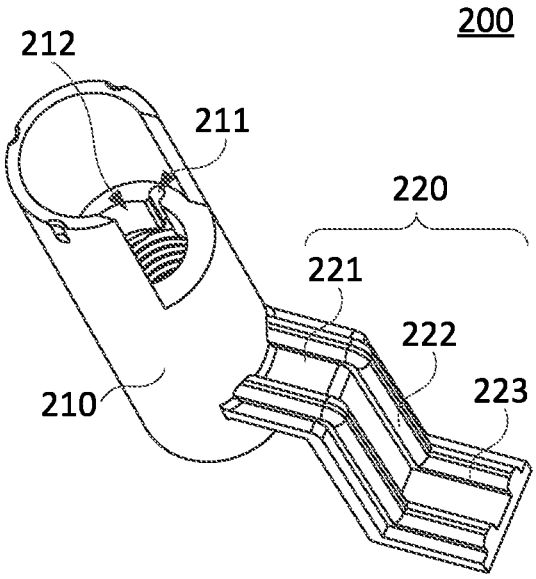
FIG. 8 is a schematic three-dimensional structural diagram illustrating an abutting piece in an embodiment of the mounting device for the speaker according to the present disclosure.

Referring to FIG. 8, in the present embodiment, the elastic piece 300 can be a spring. One end of the spring may be inserted into the central shaft 100 for fixed connection, and the inner wall of the body part 210 of the abutting piece 200 can also form a limiting groove 211, the other end of the spring may be received in the limiting groove 211 for fixed connection.

In the present embodiment, the middle part 120 of the central shaft 100 may be provided in an elliptical shape, the body part 210 of the abutting piece 200 may be formed with an elliptical through hole 212. The middle part 120 of the central shaft 100 may be nested with the through hole 212, such that the abutting piece 200 can rotate with the central shaft 100.

In other embodiments, the middle part 120 of the central shaft 100 may also be provided in a non-circular shape such as a rectangle, a triangle, or a cross, which is not limited herein.

In the present embodiment, the fixing piece 400 may include a fixed connecting part 410 and a fixed body part 420. The diameter of the fixed connecting part 410 may be smaller than that of the fixed body part 420, such that the fixed body part 420 can abutting with the base 20 after the fixed connecting part 410 penetrating through the base 20, so as to fix the mounting device 10 on the base 20.

In the present embodiment, the second fixing part 411 may be provided on the fixed connecting part 410, and the bottom of the fixing body part 420 may be further formed with a mounting hole 421, and the mounting hole 421 may be non-circular, such as hexagon, square, cross, etc., and can cooperate with the mounting tool to rotate.

In other embodiments, the mounting hole 421 may not be provided, and the fixed body part 420 may be directly provided in a non-circular shape, so as to be able to cooperate with the mounting tool to rotate.

In the present embodiment, the abutting part 220 of the abutting piece 200 may be provided in a Z-shape. The abutting part 220 may include a first bending portion 221, a second bending portion 222 and a third bending portion 223 that are connected in sequence. The first bending portion 221 may extend along the radial direction of the body part 210 of the abutting piece 200, for mounting on the top surface of the boss 201 of the base 20. The second bending portion 222 may extend along the axial direction of the body part 210, for connecting the first bending portion 221 and the third bending portion 223, and may be also used to be received in the chute 202 of the boss 201 to realize the limit of the abutting piece 200. The third bending portion 223 may extend along the radial direction of the body part 210, for abutting against the top wall 30.

Figure 9:
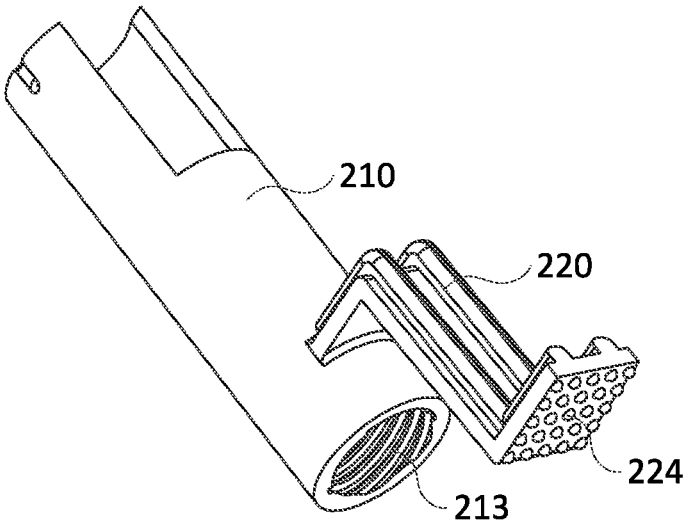
FIG. 9 is a schematic three-dimensional structural diagram illustrating the abutting piece from another perspective in an embodiment of the mounting device for the speaker according to the present disclosure.

Referring to FIG. 9, in the present embodiment, a plurality of protrusions 224 may be formed on the bottom surface of the third bending portion 223, and the protrusions 224 may be made of flexible materials, such that the frictional force between the third bending portion 223 and the top wall 30 can be increased, so as to prevent the abutting piece 200 from sliding relative to the top wall 30.

In other embodiments, the abutting part 220 of the abutting piece 200 may also be provided in an L-shape, which is not limited herein.

Figure 10:
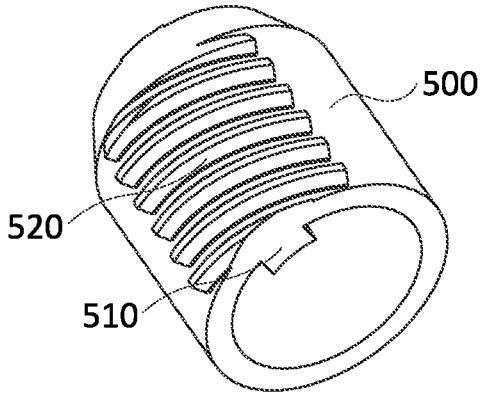
FIG. 10 is a schematic three-dimensional structural diagram illustrating a locking piece in an embodiment of the mounting device for the speaker according to the present disclosure.

Referring to FIG. 10, in the present embodiment, the mounting device 10 may further include a locking piece 500. The locking piece 500 may be provided between the central shaft 100 and the abutting piece 200 for locking with the abutting piece 200, such that the mounting position of the base 20 of the speaker and the top wall 30 can be locked.

In the present embodiment, the inner side wall of the locking piece 500 may be provided with a first limit part 510, the outer side wall of the central shaft 100 may be provided with a second limit part 130. The first limit part 510 and the second limit part 510 may be mated for a limiting, such that the central shaft 100 and the locking piece 500 can be relatively fixed.

In the present embodiment, the first limit part 510 may be a limiting protrusion, the second limit part 130 may he a limiting groove, and the limiting protrusion is received in the limiting groove to make the central shaft 100 and the locking piece 500 unable to rotate relative to each other, so as to realize the mating and limiting.

In other embodiments, the first limit part 510 may also be a limiting groove, and the second limit part 130 may be a corresponding limiting protrusion, which is not limited herein.

In other embodiments, the first limit part 510 and the second limit part 130 may also be a buckle, an interference fit structure, etc., which may be not limited herein.

In the present embodiment, one side of the outer side wall of the locking piece 500 may be provided with an outer thread 520, one side of the inner side wall of the body part 210 of the abutting piece 200 may be provided with an inner thread 213, and the outer thread 520 may be mated with the inner thread 213 to achieve locking.

In the present embodiment, when the abutting part 220 is mounted on the top surface of the boss 201, the inner thread 213 and the outer thread 520 may be spaced apart, such that the central shaft 100 and the abutting piece 200 can be flexibly rotated before the mounting device 10 is, mounted, such that it is easy to mount.

In the present embodiment, the area of the inner thread 213 may be larger than that of the outer thread 520, such that when the fixing piece 400 rotates about 90 degrees in the first direction under the action of an external force, the abutting part 220 can be received in the chute 202 of the boss 201. When the fixing piece 400 continues to rotate about 45 degrees in the first direction under the action of the external force, the locking piece 500 can be locked with the abutting piece 200, such that the base 20 and the top wall 30 may be locked.

Figure 11:
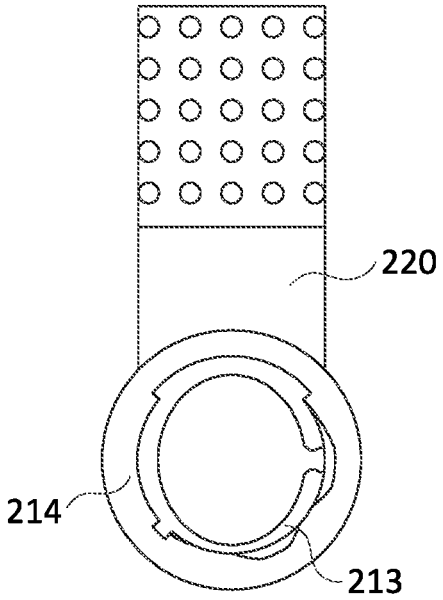
FIG. 11 is a schematic bottom view illustrating the structure of the abutting piece in an embodiment of the mounting device for the speaker according to the present disclosure.

Referring to FIG. 11, in the present embodiment, a protrusion 214 may be formed on the inner side wall of the body part 210. The protrusion 214 may be provided on one side of the inner thread 213 and can be used to limit the position of the fixing piece 400.

In the present embodiment, when the mounting device 10 needs to be disassembled, the abutting piece 200 cannot be rotated because the abutting piece 200 is limited by the chute 202, and the locking piece 500 locked with the abutting piece 200 cannot be able to rotate, such that the central shaft 100 limited by the locking piece 200 and the locking piece 500 will not rotate. The fixing piece 400 rotates in the second direction opposite to the first direction under the action of the external force, such that the fixing piece 400 can be separated from the central shaft 100. Then the disassembly of the mounting device 10 is realized, and then the body part of the speaker can be disassembled from the top wall 30.

Figure 4:
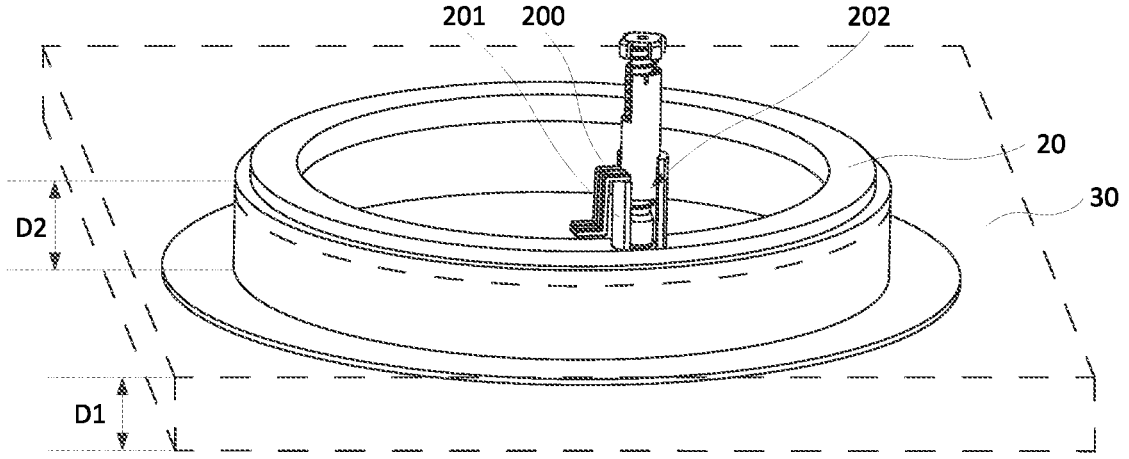
FIG. 4 is a schematic three-dimensional structural diagram illustrating a base of the speaker to be mounted in the mounting device for the speaker provided by an embodiment according to the present disclosure.

In the present embodiment, when the mounting device 10 needs to be used for the second time, the central shaft 100 and the abutting piece 200 can be adjusted to the initial positions (under the elastic tension of the elastic piece 300, the abutting piece 200 can automatically return to the initial position), and then the mounting device 10 can be re-mounted on the base 20 through the fixing piece 400 (as shown in FIG. 4), so as to re-mount the speaker body.

Figure 12:
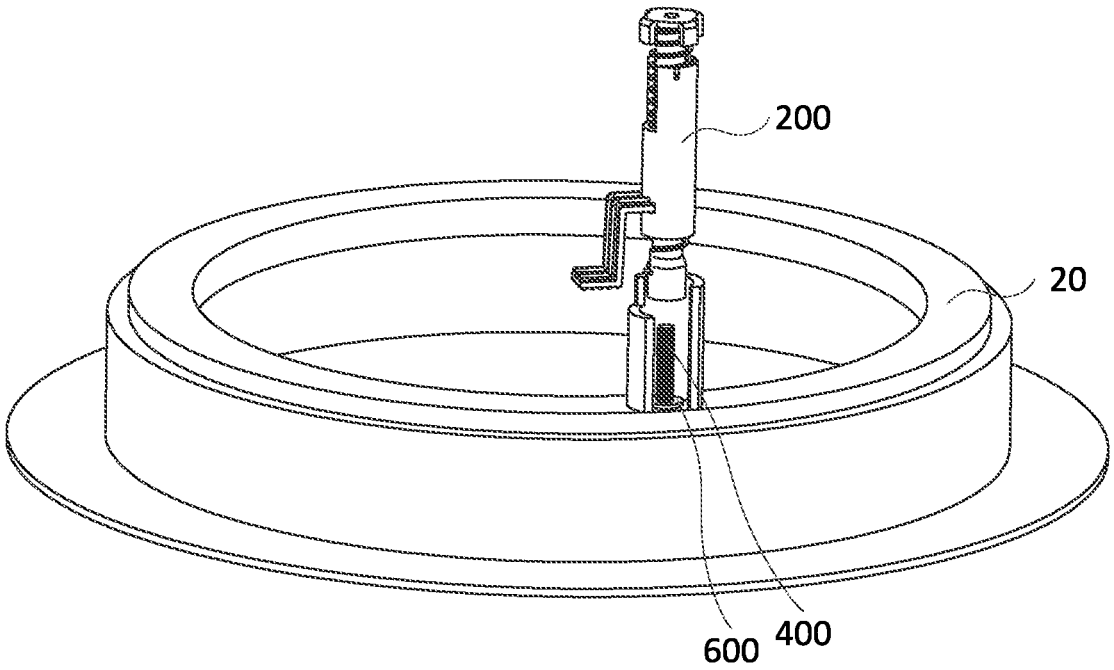
FIG. 12 is an exploded schematic view illustrating the partial structure of the mounting device and the base of the speaker in the embodiment of the mounting device for the speaker according to the present disclosure.

Referring to FIG. 12, in the present embodiment, the mounting device 10 may further include a gasket 600 provided on the fixing piece 400 and located between the base 20 of the speaker and the central shaft 100. The gasket can be used for adjusting the height of the abutting piece 200, such as to be suitable for different bases 20.

In the present embodiment, the gasket 600 may be made of flexible materials such as silicone and rubber, for playing a buffering role.

In other embodiments, the gasket 600 can also be made of rigid materials such as metal, making the mounting device more stable.

Figure 5:
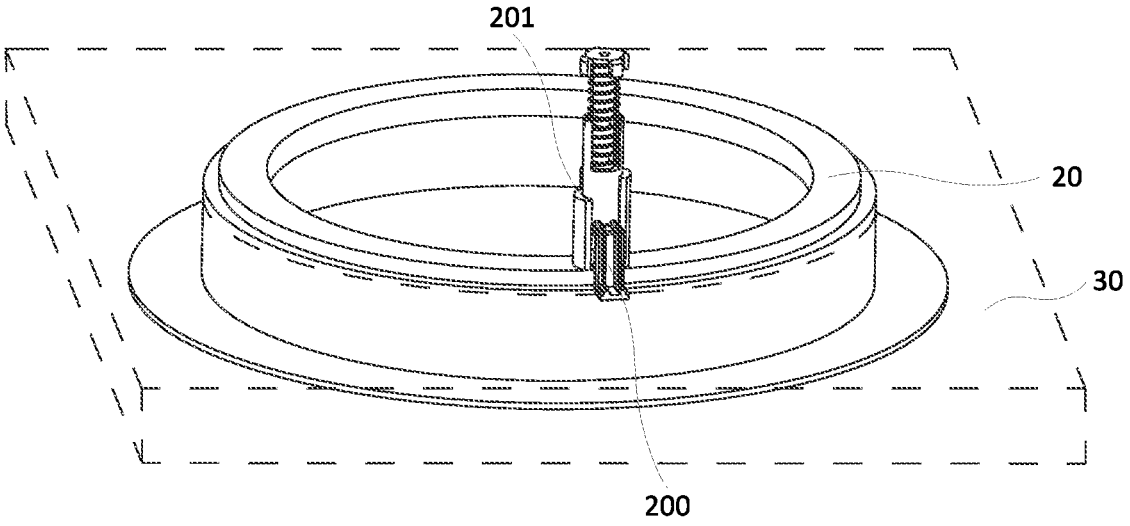
FIG. 5 is a schematic three-dimensional structural diagram illustrating a mounting state of the base of the speaker mounted on the top wall in the embodiment of the mounting device for a speaker according to the present disclosure.

Referring to FIGS. 4 and 5, a speaker body and a mounting device 10 according to an embodiment of the present disclosure are shown. The mounting device 10 is used to mount the speaker body on the top wall 30. The structure of the mounting device 10 can be referred to the above-mentioned embodiment of the mounting device 10, and details are not repeated here.

The present embodiment can make the mounting steps of the speaker body simpler, and only a simple tool such as a wrench is needed to rotate the fixing piece, which makes the mounting more convenient. Since no electric tool is required, the safety is higher and the labor intensity is lower. Lowers the risk of puncturing the speaker during installation.

The above description is only an embodiment of the present disclosure, and is not intended to limit the scope of the present disclosure. Any equivalent structure or equivalent process transformation made by using the contents of the description and drawings of the present disclosure, or directly or indirectly applied to other related technical fields are similarly included in the scope of patent protection of the present disclosure.

What is claimed is:

1. A mounting device for mounting a speaker, configured for mounting a speaker body on a top wall, wherein the mounting device comprises:

a central shaft;

an abutting piece comprising a body part and an abutting part protruding from the body part, the body part is nested with and affixedly to the central shaft;

an elastic piece provided between the central shaft and the body part, and connected or abutted with a top end of the central shaft and the abutting piece respectively;

a fixing piece penetrating through a base of the speaker so as to be connected with the central shaft, wherein, the fixing piece is configured for driving the abutting piece to rotate through the central shaft, such that the abutting part mounted on a top surface of a boss of the base is capable to be rotated to a chute of the boss so as to be abutted with the top wall.

2. The mounting device according to claim 1, further comprising a locking piece provided between the central shaft and the abutting piece, and configured for locking with the abutting piece.

3. The mounting device according to claim 2, wherein the locking piece is provided with a first limit part on an inner side wall, the central shaft is provided with a second limit part on an outer side wall, and the first limit part and the second limit part are mated for limiting a position; the locking piece is provided with an outer thread at one side of an outer side wall, and the body part of the abutting piece is provided with an inner thread at one side of an inner side wall, the outer thread and the inner thread are mated and locked.

4. The mounting device according to claim 3, wherein when the abutting part is mounted on the top surface of the boss, the inner thread and the outer thread are spaced apart, and an area of the inner thread is larger than that of the outer thread.

5. The mounting device according to claim 3, wherein the inner side wall of the body part is further formed with a protrusion provided on one side of the inner thread.

6. The mounting device according to claim 1, further comprising a gasket provided on the fixing piece and located between the base of the speaker and the central shaft.

7. The mounting device according to claim 1, wherein a middle part of the central shaft is provided in an elliptical shape, the body part of the abutting piece is formed with a through hole with an elliptical shape, and the middle part of the central shaft is nested with the through hole, such that the abutting piece is capable to rotate with the central shaft.

8. The mounting device according to claim 1, wherein the abutting part is provided in an L-shape or a Z-shape.

9. The mounting device according to claim 1, wherein one end of the elastic piece is affixed to the central shaft, and an other end is affixed to the body part of the abutting piece.

10. A speaker, comprising the speaker body and the mounting device according to claims 1, and the mounting device being configured for mounting the speaker body on the top wall.

* * * * *